US011454417B2

(12) United States Patent
Hess et al.

(10) Patent No.: US 11,454,417 B2
(45) Date of Patent: Sep. 27, 2022

(54) ROOFTOP EXHAUST FAN HAVING A MECHANISM FOR LOCKING THE FAN IN AN OPEN POSITION

(71) Applicant: Captive-Aire Systems, Inc., Raleigh, NC (US)

(72) Inventors: Joshua J. Hess, Washington Boro, PA (US); Kyle D. Thompson, Lancaster, PA (US)

(73) Assignee: Captive-Aire Systems, Inc., Raleigh, NC (US)

( * ) Notice: Subject to any disclaimer, the term of this patent is extended or adjusted under 35 U.S.C. 154(b) by 394 days.

(21) Appl. No.: 16/681,950

(22) Filed: Nov. 13, 2019

(65) Prior Publication Data

US 2021/0140675 A1 May 13, 2021

(51) Int. Cl.

| | |
|---|---|
| ***F24F 13/10*** | (2006.01) |
| ***F24F 7/02*** | (2006.01) |
| ***F24F 13/32*** | (2006.01) |

(52) U.S. Cl.

CPC ..... *F24F 13/10* (2013.01); *F24F 7/025* (2013.01); *F24F 13/32* (2013.01); *F24F 7/02* (2013.01); *F24F 2221/16* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,289,555 | B1 | 9/2001 | Nguyen et al. | |
| 2016/0252263 | A1 | 9/2016 | Chwala | |
| 2018/0135651 | A1* | 5/2018 | Howe | F04D 29/5806 |

OTHER PUBLICATIONS

Monroe-all-about-ball-and-spring-plungers; Monroe; "All About Ball and Spring Plungers" (Year: 2022).*
How Spring Plungers Work _ Monroe; Monroe; "How Spring Plungers Work" (Year: 2020).*
"Locking Hand-Retractable Plunger Avoids Accidents, Pull Pin, Watch Now!" by CarrLaneMfg, YouTube, published Nov. 27, 2017, URL: https://www.youtube.com/watch?v=tWXy9HGxoZ4 (Year: 2017).*

* cited by examiner

*Primary Examiner* — Vivek K Shirsat
(74) *Attorney, Agent, or Firm* — Coats & Bennett, PLLC

(57) ABSTRACT

The present invention relates to a rooftop exhaust fan that is pivotally mounted to a curb or other support structure and which, in response to pivoting the exhaust fan from a closed position to an inclined open position, the exhaust fan is automatically locked in the inclined open position.

14 Claims, 4 Drawing Sheets

ROOFTOP EXHAUST FAN HAVING A MECHANISM FOR LOCKING THE FAN IN AN OPEN POSITION

FIELD OF THE INVENTION

The present invention relates to rooftop ventilation systems.

BACKGROUND OF THE INVENTION

Rooftop ventilation systems are employed in various applications. They are used in general ventilation applications to exhaust air from a building. They are also employed on rooftop commercial kitchens to exhaust smoky and grease-laden air that is exhausted through a kitchen hood. These ventilation systems must be cleaned, maintained and even inspected by regulatory officials. This means that they must be opened in order that access can be gained to components of the exhaust fan and to an underlying duct. Opening some rooftop exhaust systems and maintaining them opened is not always easy. Once opened, the task becomes maintaining them opened without inadvertently closing.

SUMMARY OF THE INVENTION

The present invention relates to a rooftop exhaust fan that is pivotally mounted to a curb or other support structure and which in response to pivoting the exhaust fan from a closed position to an inclined open position, the exhaust fan is automatically locked in the inclined open position.

In one particular embodiment, a spring loaded locking pin is disposed adjacent the exhaust fan. As the exhaust fan is pivoted from the closed position towards the open position, the locking pin engages and rides on a cam surface until a locking pin opening aligns with the locking pin, after which the spring loaded locking pin is projected into the locking pin opening, thereby stationing and locking the exhaust fan in an inclined open position.

In another embodiment, a pivot art is attached to the exhaust fan and in the course of pivoting from the closed position to the open position, the exhaust fan rotates about an axis. The cam surface and locking pin opening are formed on the pivot arm. As the pivot arm pivots with the exhaust fan, the cam surface is brought in contact with the locking pin and moves the locking pin against the biasing force of the spring, after which the locking pin opening comes into alignment with the locking pin and the locking pin springs back and is projected into the locking pin opening.

Other objects and advantages of the present invention will become apparent and obvious from a study of the following description and the accompanying drawings which are merely illustrative of such invention.

DESCRIPTION OF EXEMPLARY EMBODIMENTS

Figure 1:
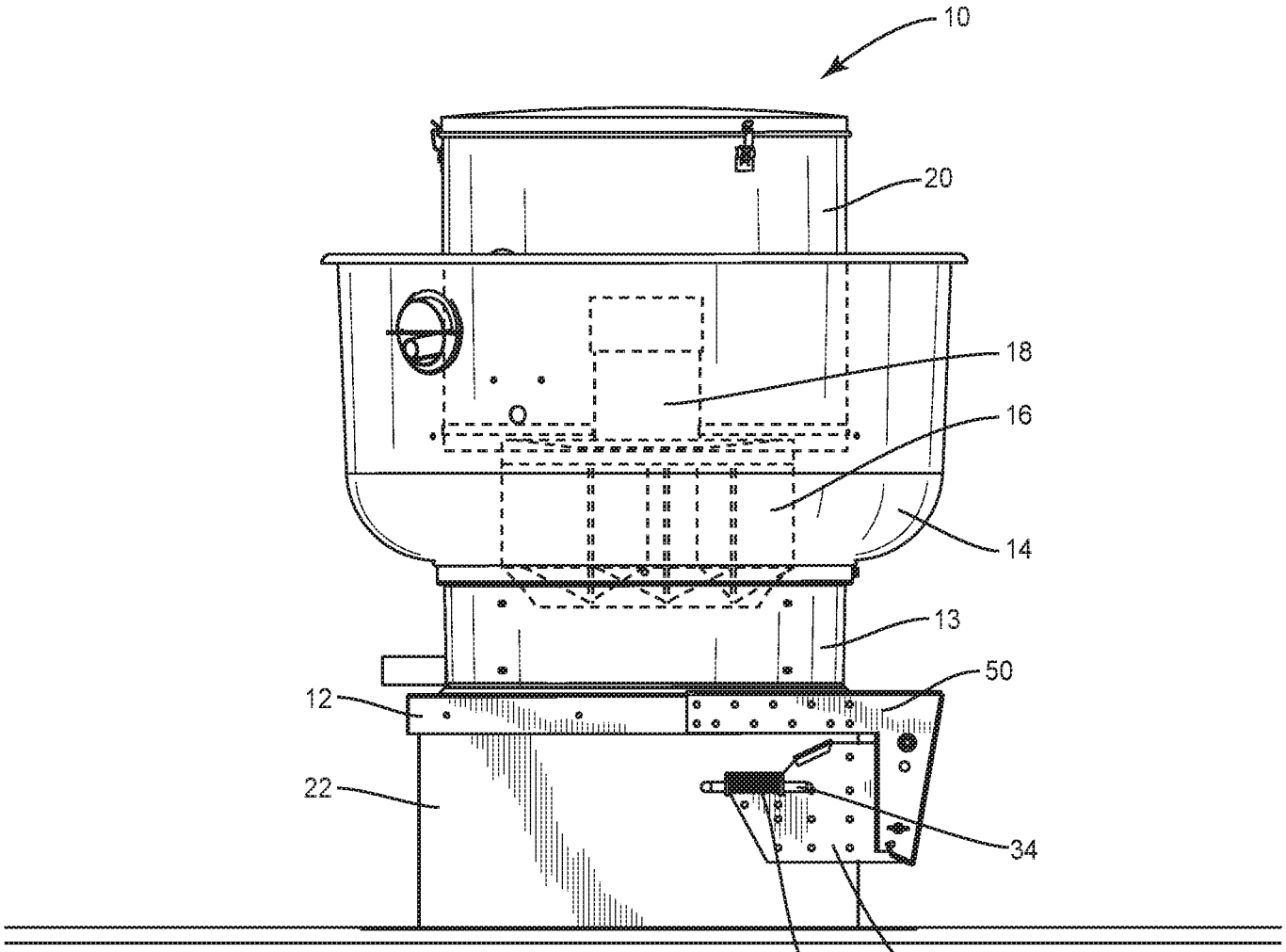
FIG. 1 is a side elevational view of the exhaust fan of the present invention shown mounted on a roof and disposed in the closed position.

With further reference to the drawings, an exhaust fan or exhaust fan assembly is shown therein and indicated generally by the numeral 10. In the embodiment illustrated, the exhaust fan is what is generally referred to as an upblast type. It is understood and appreciated by those skilled in the art that the present invention can easily be employed with a downblast-type exhaust fan. As noted above, the exhaust fan 10 can be used for general ventilation or can be used in conjunction with a commercial kitchen to exhaust smoky and grease-laden air that emanates from a cooking surface generally disposed underneath a hood.

Viewing the exhaust fan in more detail, it is seen that the same includes a base 12. Extending upwardly from the base 12 is a baffle 13. Baffle 13 transitions into an apron 14. Apron 14 forms a large bowl having a central opening that is aligned with the baffle 13.

Exhaust fan 10 is provided with a means for inducing air to move upwardly through the exhaust fan where the air is exhausted to the atmosphere. Various fan and motor arrangements can be incorporated into the exhaust fan 10. In this exemplary embodiment, the exhaust fan 10 includes a fan wheel or propeller for generating an upwardly moving system of air. In the case of the exhaust fan assembly shown in the drawings, a fan wheel is provided. It is understood and appreciated to those skilled in the art that various types of fans can be incorporated into the exhaust fan assembly 10. Fan wheel 16 is centrally mounted in the exhaust fan 10 and is supported by internal structure that is well appreciated by those skilled in the art. Fan wheel 16 is driven by a motor 18. Typically the motor 18 is aligned with and disposed over or under the fan wheel or propeller in the case of a direct drive design. Generally when a direct drive is employed, the fan wheel or propeller is essentially mounted to the drive shaft of the motor 18 or to an extension therefrom. In other cases, the fan wheel or propeller can be driven from a side mounted motor through a belt drive.

In order to protect the motor 18, as well as the fan wheel or propeller, the exhaust fan is provided with a housing 20. Note that the housing 20 partially encompasses both the motor 18 and the fan wheel 16. When the fan wheel 16 is driven by the motor 18, this results in a system of air moving upwardly through the exhaust fan 10. There is provided an annular opening formed generally between the housing 20 and the apron 14. It is through this annular opening that the air is exhausted from the exhaust fan.

Typically, the exhaust fan 10 is of the type that is mounted on the roof of a building. See FIGS. 1-2. In particular, there is provided a curb or support structure 22 that extends upwardly from the roof. Exhaust fan 10 is mounted and supported by the curb or support structure 22. Note as seen in the drawings where the base 12 of the exhaust fan 10 sits on the curb or support structure 22. Furthermore, it is appreciated that the curb or support structure 22 is communicatively connected to an underlying duct or duct network that extends from the curb.

Figure 2:
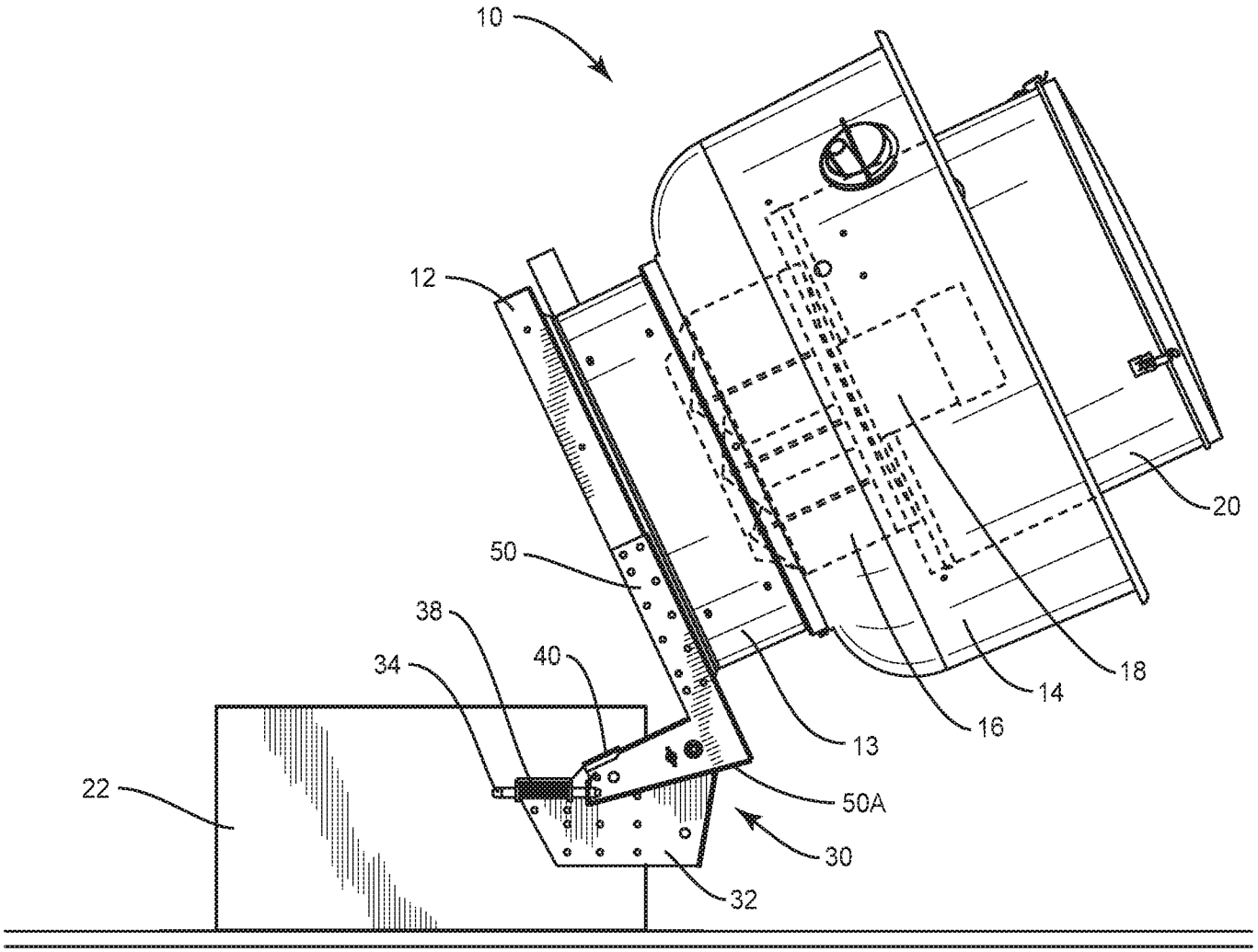
FIG. 2 is a side elevational view of the exhaust fan shown in the inclined open position.

As discussed above, the exhaust fan 10 is pivotally mounted to the curb or support structure 22 such that it can move from a closed position (FIG. 1) to an inclined open position (FIG. 2). In the closed position, the base 12 extends transversely across the top of the curb or support structure 22. In the inclined open position, the fan assembly 10 is pivoted such that there is an open area between the curb or support structure 22 and the base 12 of the fan assembly. This enables repair and maintenance personnel to gain access to the fan wheel 16, motor 18 and the area around the fan wheel and motor, as well as the interior of the curb or support structure 22.

Figure 5:
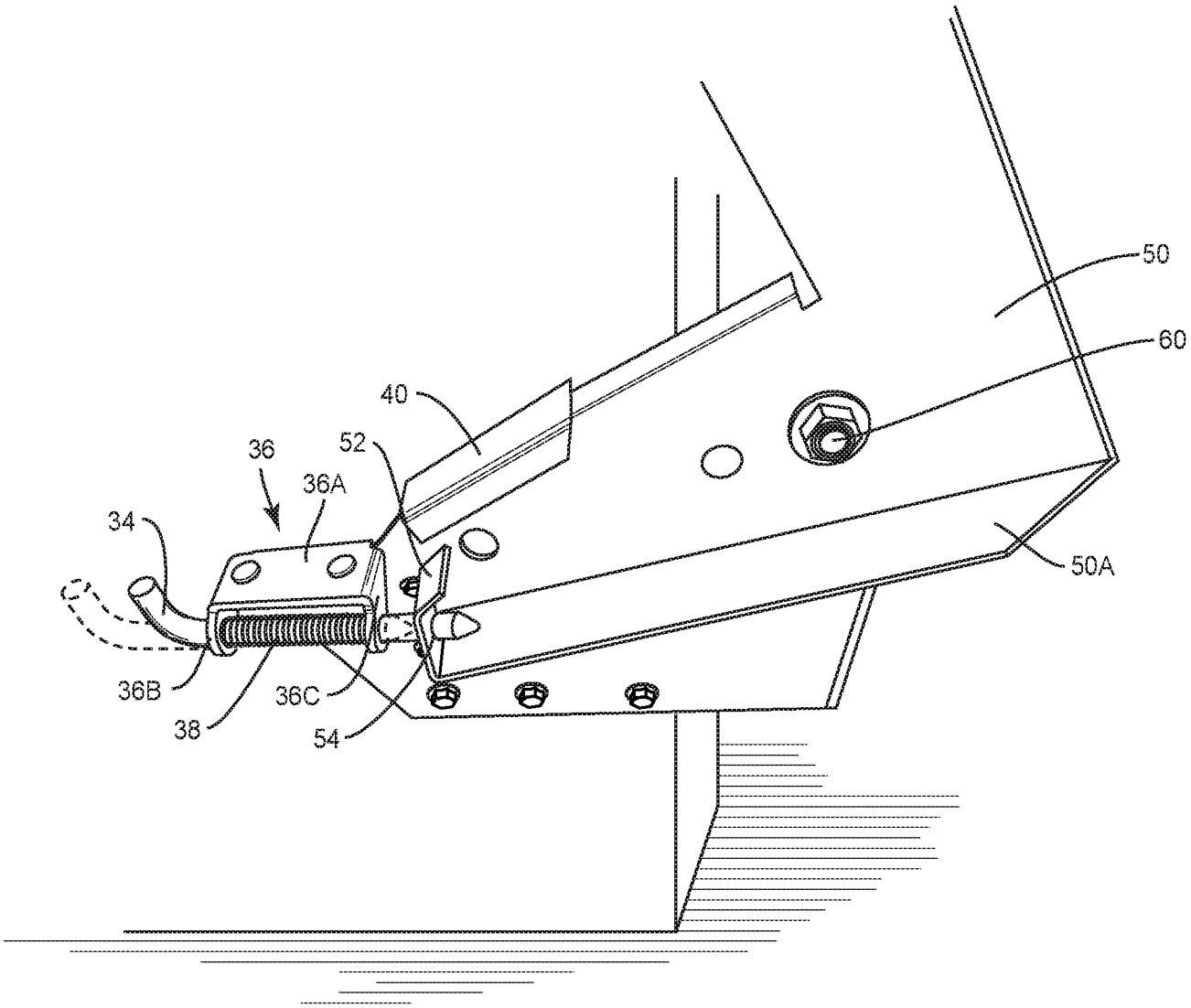
FIG. 5 is a fragmentary perspective view of the locking assembly incorporated into the exhaust fan.

In order to secure the exhaust fan 10 in the inclined open position for maintenance, cleaning or inspection, the exhaust fan of the present invention is provided with a locking assembly, indicated generally by the numeral 30, for stationing and locking the exhaust fan in the inclined open position. Viewing the locking assembly 30 in detail, a support plate 32 is fixed to the curb or other support structure 22. A locking pin 34 is supported on the support plate 32. In particular, the locking pin 34 is held by a locking pin holder 36 that projects outwardly from the support plate 32. Locking pin holder includes an upper plate 36A and a pair of spaced apart flanges 36B and 36C. See FIG. 5. Openings are provided in the flanges 36B and 36C. As shown in the drawings, locking pin 34 projects through the openings in the flanges 36B and 36C. A coil spring 38 is disposed around the portion of the locking pin disposed between the two flanges 36B and 36C. In this embodiment, the right end of the spring 38, as viewed in FIG. 5, is fixed to the locking pin 34 while the other end of the coil spring engages the left most flange 36B.

Figure 4:
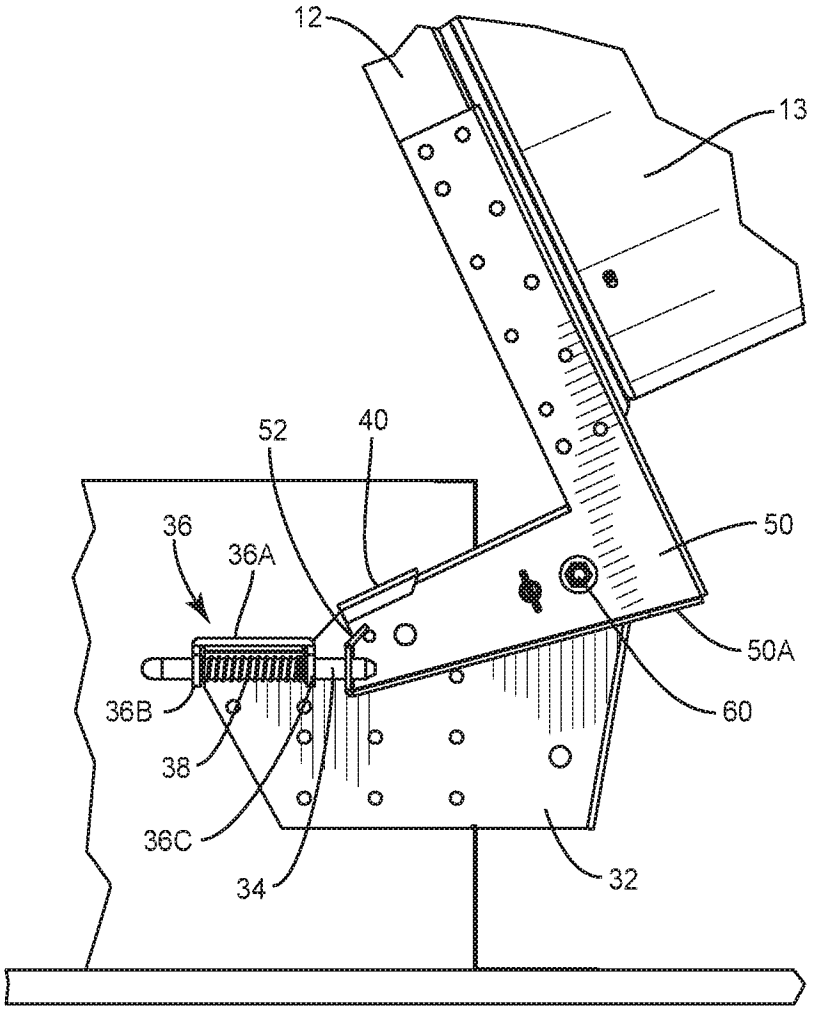
FIG. 4 is a view similar to FIG. 3 except that the locking assembly is disposed in the locked position.
Figure 3:
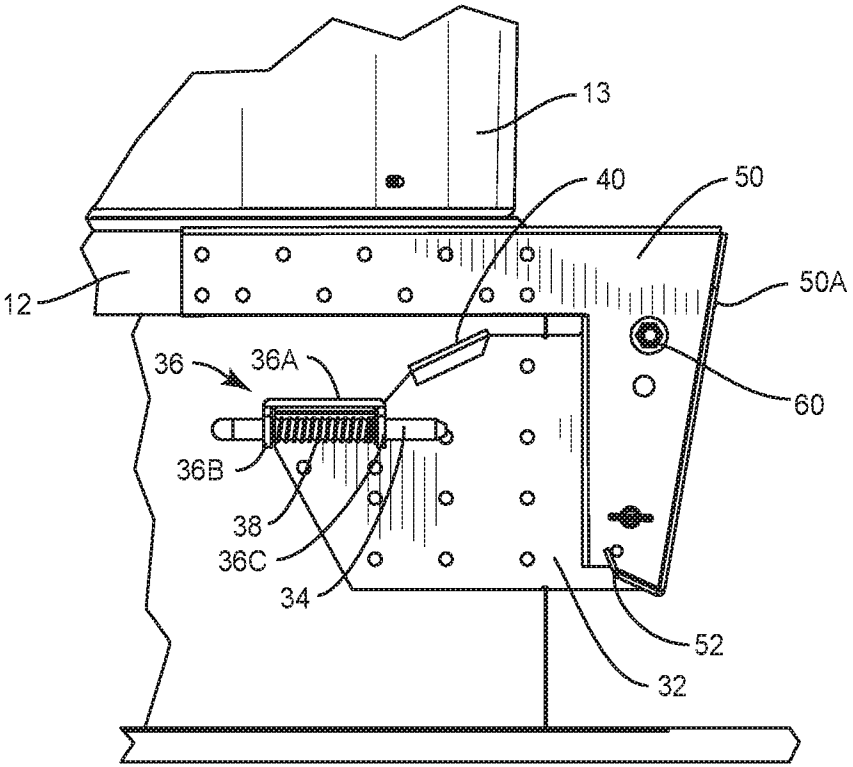
FIG. 3 is a fragmentary side elevational view showing the locking assembly incorporated into the exhaust fan for stationing and locking the exhaust fan in the open position.

A tab 40 extends outwardly from one edge of the support plate 32. See FIGS. 3-5. As described below, the function of the tab 40 is to limit the rotation of the exhaust fan 10 as the fan assembly rotates from the closed position to the inclined open position.

A pivot arm 50 is connected to the exhaust fan 10. In the case of this embodiment, as shown in the drawings, the pivot arm 50 is fixed to the base 12 of the fan assembly 10. Pivot arm 50 in this embodiment assumes a generally L-shape. Another portion of the pivot arm 50 is pivotally connected to the plate 32 about pivot pin 60 or another adjacent fixed structure. It is the pivot arm 50 that enables the exhaust fan to be pivoted back and forth between the closed and open positions.

Pivot arm 50 includes a flange 50A that projects outwardly from the pivot arm. Flange 50A about a terminal end thereof includes a cam surface or ramp 52 disposed on one terminal end. Furthermore, formed in the flange 50A is a locking pin opening 54. Note that the cam surface 52 and the locking pin opening 54 lie in the same plane as the locking pin 34. As seen in the drawings, when exhaust fan 10 assumes the closed position, the cam surface 52 is angled with respect to that portion of the flange 50A that contains the locking pin opening 54. In this position, the cam surface 52 lies above the locking pin opening 54.

A brief review of the locking assembly 30 and how it stations and locks the exhaust fan 10 in the inclined open position follows. To gain access to the interior of the exhaust fan 10 and to at least a portion of the curb 22, the exhaust fan is pivoted from the closed position to the inclined open position. As the exhaust fan is rotated clockwise, as viewed in FIGS. 1-2, it follows that the pivot arm 50 secured thereto also rotates. As the exhaust fan rotates towards the open position, the cam surface 52 moves towards the locking pin 34. Since the cam surface 52 is aligned with the locking pin 34 and lies in the same plane of the locking pin, it follows that at some point the locking pin 34 will engage the cam surface 52. This occurs just prior to the fan assembly 10 reaching the inclined open position. Once the locking pin 34 is engaged by the cam surface 52, the locking pin tends to ride the moving cam surface 52 until the locking pin opening 54 aligns with the locking pin opening 54. As the locking pin 34 rides on the moving cam surface 52, the coil spring 38 is compressed. This is because one end of the coil spring, as pointed out above, is fixed to the locking pin. Once the locking pin opening 54 is rotated to a point where it aligns with the locking pin 34, the spring 38 biases the locking pin into and through the locking pin opening 54. Now the exhaust fan 10 is stationed and locked in the inclined open position. The locking pin will prevent the inadvertent closing of the exhaust fan 10. Now the exhaust fan 10 can be cleaned, maintained, repaired or even inspected if periodic inspections are required.

To bring the exhaust fan 10 back to the closed position, the locking pin 34 is manually retracted from the locking pin opening 54 and the fan assembly is slowly lowered from the open position to the closed position where the base 12 of the fan assembly 10 seats on the curb or support structure 22.

There are many advantages to the automatic locking assembly 30 that is incorporated into the exhaust fan 10. First, the locking assembly 30 is simple in design and operation. Secondly, the locking assembly 30 is designed such that it will automatically lock the exhaust fan 10 in the inclined open position simply as a result of the exhaust fan being sufficiently rotated to engage the locking assembly. Finally, the locking assembly is strong and robust and designed to securely support the weight of the fan assembly when it assumes the inclined opening position.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A rooftop exhaust system for exhausting air from a building, comprising:

a fan assembly pivotally connected to a curb or support structure and moveable back and forth from a closed position to a tilted open position;

the fan assembly including a base, a housing, a motor disposed in the housing, and a fan driven by the motor and configured to induce air to move from the building through the fan assembly;

a pivot arm fixed to the housing and extending therefrom and configured to pivot about an axis;

a locking pin opening disposed on the pivot arm;

a cam surface disposed on the pivot arm adjacent the locking pin opening;

a plate configured to be secured to the curb or support structure;

a spring biased locking pin mounted on the plate and aligned with the cam surface and the locking opening; and the spring biased locking pin, cam surface and locking pin opening configured such that as the fan assembly is pivoted from the closed position toward the open position, the spring biased locking pin engages the cam surface and rides along the cam surface and thereafter is biased into the locking opening which stations and locks the fan assembly in the tilted open position.

2. The rooftop exhaust system of claim 1 wherein the pivot arm includes a flange that projects outwardly from the pivot arm and wherein the locking pin opening is formed in the flange and wherein the flange is configured to form the cam surface.

3. The rooftop exhaust system of claim 2 wherein when the fan assembly assumes the open position, a terminal end portion of the flange includes the cam surface and the locking opening is disposed in the flange below the cam surface.

4. The rooftop exhaust system of claim 1 wherein the plate includes a locking tab that projects outwardly from the plate and is configured to engage the pivot arm and limit the pivotable movement of the pivot arm.

5. The rooftop exhaust system of claim 1 wherein the spring biased locking pin is supported within a holder and includes a spring fixed at one end to the locking pin and confined about the other end by the holder.

6. The rooftop exhaust system of claim 1 wherein the pivot arm comprises an L-shaped pivot arm including a flange and wherein the cam surface and locking opening are formed in the flange.

7. The rooftop exhaust system of claim 1 wherein the pivot arm is connected to the base of the fan assembly and projects therefrom and pivotally connected to the plate.

8. The rooftop exhaust system of claim 7 wherein the pivot arm assumes a generally L-shape.

9. The rooftop exhaust system of claim 1 wherein the pivot arm is pivotally mounted to the plate.

10. A method of opening a rooftop fan assembly and locking the fan assembly in an open position comprising:

pivoting the fan assembly from a generally vertical closed position to an inclined open position;

while pivoting the fan assembly, engaging a spring biased locking pin mounted on a stationary structure with a cam surface that moves with the fan assembly and compressing a spring associated with the locking pin as the locking pin rides on the cam surface;

moving the locking pin on the cam surface towards a locking pin opening that also moves with the fan assembly;

continuing to pivot the fan assembly until the locking pin opening aligns with the locking pin; and spring biasing the locking pin into the locking pin opening and securely stationing and locking the fan assembly in the open position.

11. The method of claim 10 wherein the stationary structure comprises a plate mounted to a curb which underlies the fan assembly and wherein the locking pin forms a part of a locking pin assembly that is fixed to the plate.

12. The method of claim 10 wherein the cam surface and locking pin opening are disposed on a pivot arm that is fixed to the fan assembly and pivotally mounted about a transverse axis.

13. The method of claim 10 wherein a pivot arm is connected to the fan assembly and moves with the fan assembly from the closed position to the open position, and wherein the stationary structure includes a tab that projects into the path of the pivot arm and limits the pivotable movement of the pivot arm.

14. The method of claim 10 wherein a generally L-shaped pivot arm is secured to the fan assembly and moves with the fan assembly as the fan assembly moves from the closed position to the open position, and wherein a flange projects from the pivot arm and wherein both the cam surface and locking pin opening are disposed on the flange.

* * * * *